US010258852B1

(12) United States Patent
Walker

(10) Patent No.: US 10,258,852 B1
(45) Date of Patent: Apr. 16, 2019

(54) GARAGE STORAGE NET

(71) Applicant: Walker Sports Innovations, LLC, Clearwater, FL (US)

(72) Inventor: John David Walker, Clearwater, FL (US)

(73) Assignee: Walker Sports Innovations, LLC, Clearwater, FL (US)

( * ) Notice: Subject to any disclaimer, the term of this patent is extended or adjusted under 35 U.S.C. 154(b) by 0 days.

(21) Appl. No.: 15/990,219

(22) Filed: May 25, 2018

Related U.S. Application Data

(63) Continuation-in-part of application No. 15/450,165, filed on Mar. 6, 2017, which is a continuation-in-part
(Continued)

(51) Int. Cl.
*A63B 63/00* (2006.01)
*A63B 71/02* (2006.01)
(Continued)

(52) U.S. Cl.
CPC ..... *A63B 63/00* (2013.01); *A63B 69/0002* (2013.01); *A63B 71/022* (2013.01); *A63B 47/02* (2013.01); *A63B 2063/006* (2013.01); *A63B 2069/0008* (2013.01); *A63B 2210/50* (2013.01); *B65D 33/002* (2013.01)

(58) Field of Classification Search
CPC ..... A63B 71/022; A63B 2063/006; A63B 2210/50; B60R 7/005; B60R 7/02
USPC ..... 473/197, 439, 451, 462, 494, 476–478, 473/454–456, 435, 446, 473, 474; 273/398–402; 160/127, 201; 211/86.01,
(Continued)

(56) References Cited

U.S. PATENT DOCUMENTS 4,118,028 A * 10/1978 Larkin ..... A63B 63/00 273/394
4,153,246 A * 5/1979 Byrne ..... A63B 63/00 160/113
(Continued)

OTHER PUBLICATIONS

Screenshot of video on Youtube of Cobra Garage Door Storage Web and Clamp-On Hooks with Pete Wagner. iCast 2018. Published on Jul. 11, 2018. https://www.youtube.com/watch?reload=9&v=_dgD_scgU_s.

*Primary Examiner* — Mark S Graham
(74) *Attorney, Agent, or Firm* — Paul Murty; Nicholas Pfeifer; Smith & Hopen, P.A.

(57) ABSTRACT

An athletic training net for receiving projectiles. The training net has a storage sleeve affixed to an upper end, wherein the storage sleeve includes a plurality of upper grommets at an upper end and a plurality of lower grommets at a lower end. The training net further includes a plurality of hook and strap fasteners, with each comprising of a strap secured to a structural member of a garage door and a hook for catching the plurality of upper and lower grommets. The training net has a training configuration and a storage configuration. In the training configuration, the hooks are received by the plurality of upper grommets and the net is vertically suspended form the garage door. In the storage configuration, the plurality of upper grommets remains suspended from the hooks, the net is enfolded in the storage sleeve, and the plurality of lower grommets is secured by the hooks.

20 Claims, 11 Drawing Sheets

Related U.S. Application Data of application No. 15/097,982, filed on Apr. 13, 2016, now Pat. No. 9,623,306.

(60) Provisional application No. 62/253,756, filed on Nov. 11, 2015.

(51) Int. Cl.

| | |
|---|---|
| ***A63B 69/00*** | (2006.01) |
| *A63B 47/02* | (2006.01) |
| *B65D 33/00* | (2006.01) |

(58) Field of Classification Search

USPC ..... 211/87.01, 88.01, 119.004; 49/70, 197, 49/199; 232/19

See application file for complete search history.

(56) References Cited

U.S. PATENT DOCUMENTS

| | | | | | |
|---|---|---|---|---|---|
| D291,754 | S | * | 9/1987 | Griswold | D6/553 |
| 5,000,461 | A | * | 3/1991 | Borazjani | A63B 63/00 273/400 |
| 5,007,645 | A | * | 4/1991 | Weigl | A63B 63/00 273/407 |
| 5,337,907 | A | * | 8/1994 | McKenzie | A45F 3/00 206/427 |
| 5,571,266 | A | * | 11/1996 | Nichols | A63B 63/00 273/127 R |
| 5,685,470 | A | * | 11/1997 | Moore | B60R 7/005 224/567 |
| 5,947,831 | A | * | 9/1999 | McCarthy | A63B 63/00 473/197 |
| 6,189,889 | B1 | * | 2/2001 | Yip | A63B 63/00 273/348 |
| 6,543,659 | B2 | * | 4/2003 | Blair | B60R 9/045 220/9.2 |
| 6,969,068 | B1 | * | 11/2005 | Pollon | A63B 63/00 273/400 |
| 7,942,618 | B1 | * | 5/2011 | Looker | B64D 9/00 410/118 |
| 7,958,925 | B2 | | 6/2011 | Murray | |
| 8,246,494 | B2 | * | 8/2012 | Stephenson | A63B 63/004 473/422 |
| 9,174,107 | B2 | * | 11/2015 | Dettor | A63B 61/00 |
| 9,289,673 | B1 | * | 3/2016 | Allen | A63B 71/022 |
| 9,623,306 | B1 | * | 4/2017 | Walker | A63B 63/00 |
| 2002/0043543 | A1 | * | 4/2002 | McMurray | B60R 7/005 224/563 |
| 2009/0029807 | A1 | * | 1/2009 | Sifrit | A63B 63/004 473/478 |
| 2010/0081513 | A1 | * | 4/2010 | La Pointe | A63B 63/00 473/197 |
| 2010/0290856 | A1 | * | 11/2010 | Zahorec | B60R 7/005 410/118 |
| 2016/0325686 | A1 | * | 11/2016 | Krishnan | B60R 5/047 |
| 2016/0375332 | A1 | * | 12/2016 | Edwards | A63B 63/004 473/476 |

* cited by examiner

GARAGE STORAGE NET

CROSS-REFERENCE TO RELATED APPLICATIONS

This nonprovisional application is a continuation-in-part of and claims priority to nonprovisional application Ser. No. 15/450,165, entitled "Athletic Training Net," filed Mar. 6, 2017 by the same inventor, which is a continuation-in-part of and claims priority to U.S. Pat. No. 9,623,306 B1, entitled "Athletic Training Net," issued Apr. 18, 2017 by the same inventor, which is a continuation of and claims priority to provisional application No. 62/253,756, entitled "Garage Sports Net," filed Nov. 11, 2015 by the same inventor.

BACKGROUND OF THE INVENTION

1. Field of the Invention

This invention relates, generally, to a storage net device. More specifically, it relates to a storage net device that is adapted to suspend from a garage door.

2. Brief Description of the Prior Art

Year-round athletic training, particularly in baseball and softball, is a necessity for maximizing an athlete's potential to compete at the highest level. Consistent year-round training, however, can be difficult to maintain given the changes in weather and the high cost and low availability of indoor training facilities. In addition, it can be difficult for athletes with a busy schedule to find time to travel to training facilities and travel times inherently take away from training time.

Currently, there exist several athletic training devices for providing at home training. Some examples include U.S. Pat. Nos. 5,725,444, 7,293,776, 5,876,291, and 5,571,266. Each of these patents discloses a training device suspended to a garage door or a garage door opening and several include a plurality of pockets/sleeves for receiving and securing a ball or similar sports object. Hereinafter a ball or similar sports object will be collectively referred to as a "projectile." Each of these training devices, however, fails to disclose a simple, inexpensive, and easy to use storage sleeve affixed to both an upper end of the training device and a garage door. Similarly, U.S. Pat. No. 7,958,925 discloses a garage door storage device suspended from a garage door; however, the disclosed storage device does not include a storage sleeve, and thereby lacks the ability to store and secure a storage net therein.

Accordingly, what is needed is a training or storage net having a simple, inexpensive, and easy to use storage sleeve adapted to affix to the inside of a garage door. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a storage net having a simple, inexpensive, and easy to use storage sleeve adapted to affix to the inside of a garage door is now met by a new, useful, and nonobvious invention.

The novel structure includes a net having a rear barricade and a front barricade, each barricade including lower end and an upper end with a height extending therebetween, a pair of sides with a width extending therebetween. A receiving pocket is disposed between the rear and front barricades, and is designed to receive and retain items therein for storage.

A storage sleeve is affixed to the upper end of the rear barricade of the net, which forms a backing structure. The storage sleeve has an upper end with a plurality of grommets disposed therein. Each upper grommet is aligned about a first horizontal axis. The lower end, likewise, has a plurality of lower grommets with each lower grommet aligned about a second horizontal axis. In addition, at least two of the upper grommets are vertically aligned with a lower grommet.

In an embodiment, the upper end of the rear barricade of the net is secured to the storage sleeve between the plurality of upper and lower grommets. An elastic cord is disposed at the upper end of the front barricade of the net, with the elastic cord being insertable through the upper grommets and allowing access to the receiving pocket. The elastic cord mechanically connects the net to a garage door, helps retain items stored within the receiving pocket, and allows a user to access the receiving pocket by exerting a pulling force on the elastic cord.

The present invention further includes a plurality of hook and strap fasteners. Each strap is secured around a structural member of a garage door and each hook is received by a loop formed by the elastic cord that is in communication with the net. In a first storage configuration, the net is suspended vertically from the garage door by releasing the lower grommets from the hooks while the upper grommets remain suspended from the hooks. In a second storage configuration, the hooks catch both the upper and lower grommets when the net is enfolded in the storage sleeve.

In an embodiment, the storage sleeve has a width greater than or equal to the width of the rear barricade of the net, such that the entire net can be enfolded in the storage sleeve. In an embodiment, the storage sleeve is comprised of a smooth outer surface to prevent objects from catching on the storage sleeve when secured in the storage configuration.

In an embodiment, the net includes a lower elastic cord which is sized and shaped to span between subsequent horizontally-aligned roller mechanisms on a garage door, such that the elastic cord has a length less than or equal to the distance between the subsequent roller mechanisms. The lower elastic cord secures to the garage via a loop and the hook and strap fasteners described above. Because the length of the lower elastic cord is less than or equal to the distance between subsequent roller mechanisms, the lower elastic cord is stretched to secure to the garage, further securing the net to the garage.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is an athletic training or storage net having a simple, inexpensive, and easy to use storage sleeve adapted to affix preferably to the inside of a garage door. The storage sleeve allows the net to be secured to the garage door indefinitely without hindering the intended operation of the garage door. The training net easily and quickly transitions between a storage orientation and training orientation allowing an athlete to maximize his/her training time.

Figure 1:
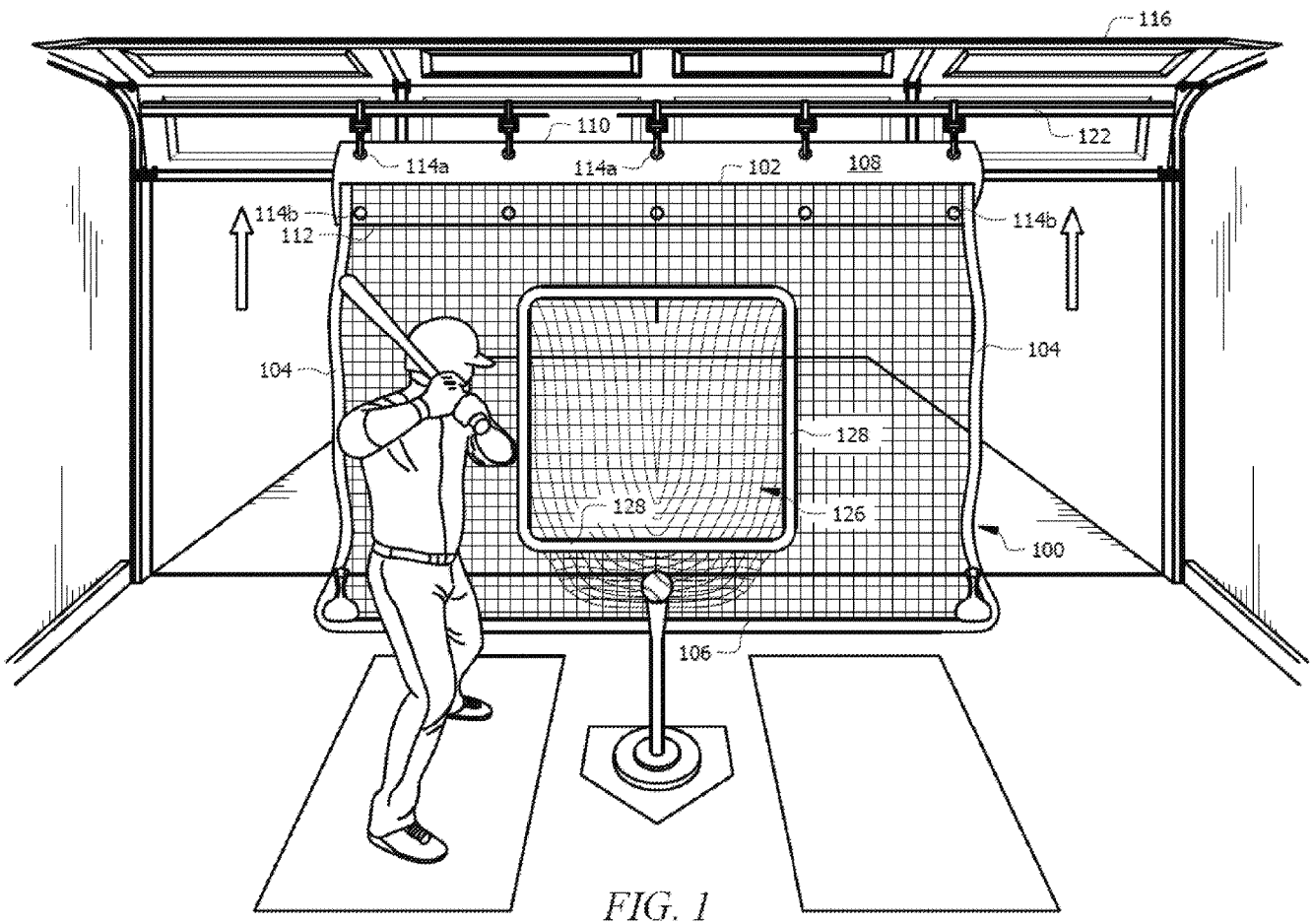
FIG. 1 depicts an embodiment of the present invention wherein the training net is suspended from the garage door when the garage door is in an open configuration.
Figure 2:
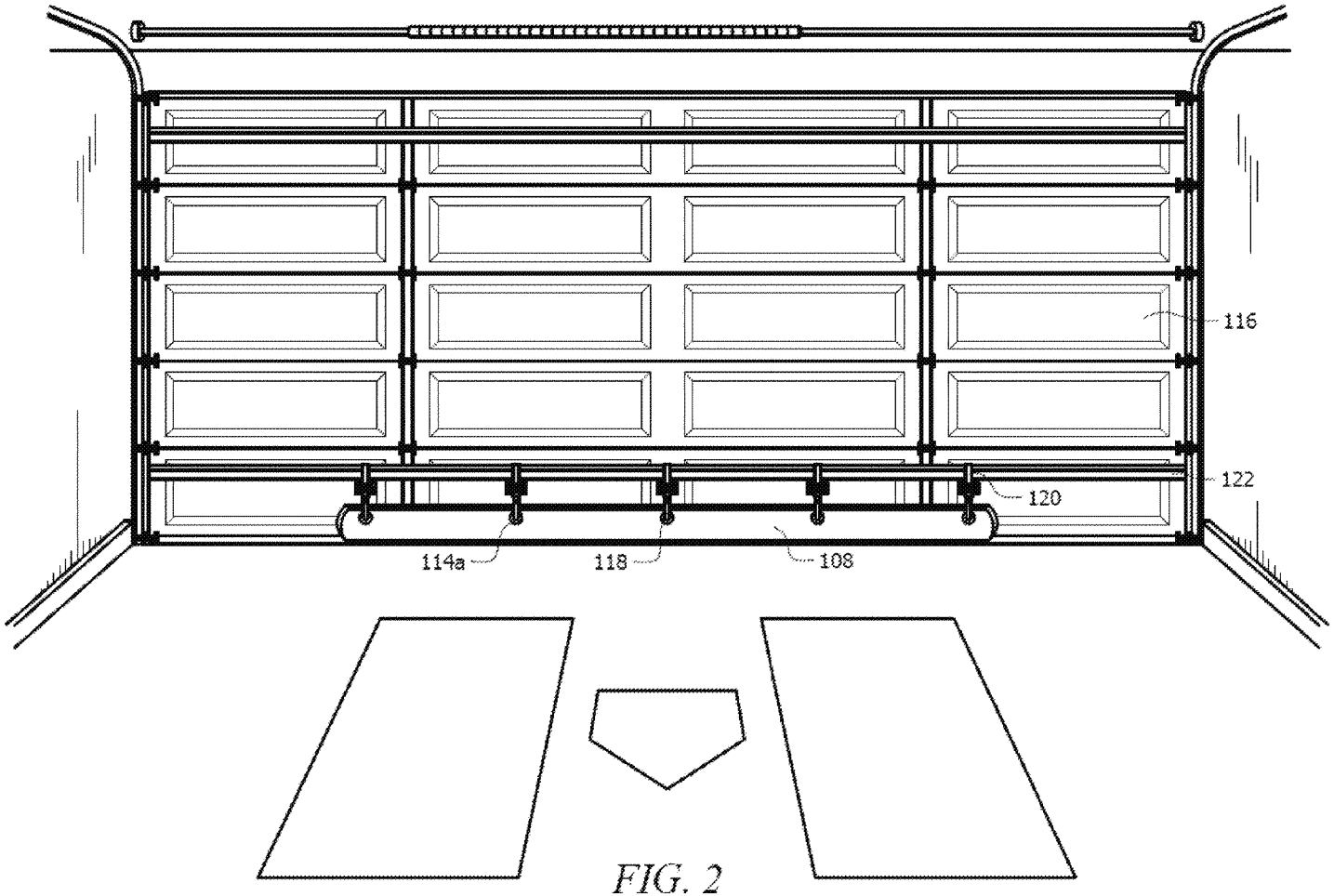
FIG. 2 depicts an embodiment of the present invention wherein the training net is secured within the storage sleeve.

As depicted in FIG. 1, an exemplary embodiment of the training net is generally denoted by reference numeral 100. Net 100 has a generally rectangular shape comprised of upper end 102, sides 104, and lower end 106. Upper end 102 includes storage sleeve 108, which is adapted to be secured to garage door 116. When garage door 116 is opened, as shown in FIG. 1, storage sleeve 108 can be opened to release net 100. Net 100 suspends from garage door 116 allowing, as shown in FIG. 1, a baseball player to hit baseballs into net 100. When finished training, the user can simply lower garage door 116, roll net 100 into storage sleeve 108, and secure sleeve 108 to garage door 116, as is shown in FIG. 2.

Referring back to FIG. 1, storage sleeve 108 includes upper end 110 and lower end 112. Both ends 110, 112 include a plurality of grommets 114*a*, 114*b* disposed therein. Upper grommets 114*a* are preferably equidistantly spaced from each another and aligned horizontally along the width of storage sleeve 108. Likewise, lower grommets 114*b* are preferably equidistantly spaced from each another and aligned horizontally along the width of storage sleeve 108. The embodiment in FIGS. 1-2 includes 5 upper grommets 114*a* and five lower grommets 114*b*, however, any number of grommets may be used so long as the weight of net 102 is appropriately distributed to prevent tearing of grommets 114*a*, 114*b* from storage sleeve 108.

Upper grommets 114*a* and lower grommets 114*b* are vertically spaced inwardly, towards the longitudinal axis of storage sleeve 108, from their respective ends 110, 112. In an embodiment, upper and lower grommets 114*a*, 114*b* are spaced an equal distance from their respective upper and lower ends 110, 112.

Storage sleeve 108 is preferably permanently integrated into upper end 102, however, it is considered that upper end 102 may be temporarily secured to storage sleeve 108. Upper end 102 is secured to storage sleeve 108 between upper and lower grommets 114*a*, 114*b*. This attachment location enables the entirety of net 100 to be located between grommets 114*a*, 114*b* when net 100 is rolled into storage sleeve 108. As a result, net 100 does not interfere with hooks 118 when received by grommets 114*a*, 114*b* in the storage configuration.

Storage sleeve 108 preferably includes a width that extends at least as wide as the width of net 100. If viewing FIG. 1, the width of net 100 extends between sides 104. By having a width greater than or equal to the width of net 100, sleeve 108 can fully enfold net 100 and prevent net 100 from catching on any objects that might contact storage sleeve 108 when net 100 is fully enfolded in storage sleeve 108. For the same reason, storage sleeve 108 is made of a smooth preferably impermeable material, such as a two-ply vinyl fabric. The two-ply fabric provides additional durability while still remaining pliable for attaching to the net. The vinyl fabric includes the added benefits of being durable, inexpensive to manufacture, easy to clean, and odor resistant.

The present invention further includes a series of hook and strap fasteners for securing storage sleeve 108 to garage door 116. Each hook and strap fastener includes hook 118 and strap 120. Straps 120 are secured to a structural member of garage door 116 while hooks 118 catch grommets 114*a*. As shown in FIG. 1, upper grommets 114*a* are intended to remain secured by hooks 118 when net 100 is suspended from garage door 116. As shown in FIG. 2, lower grommets 114*b* also receive hooks 118 when net 100 is enfolded into storage sleeve 108 and stored for future use.

Figure 3:
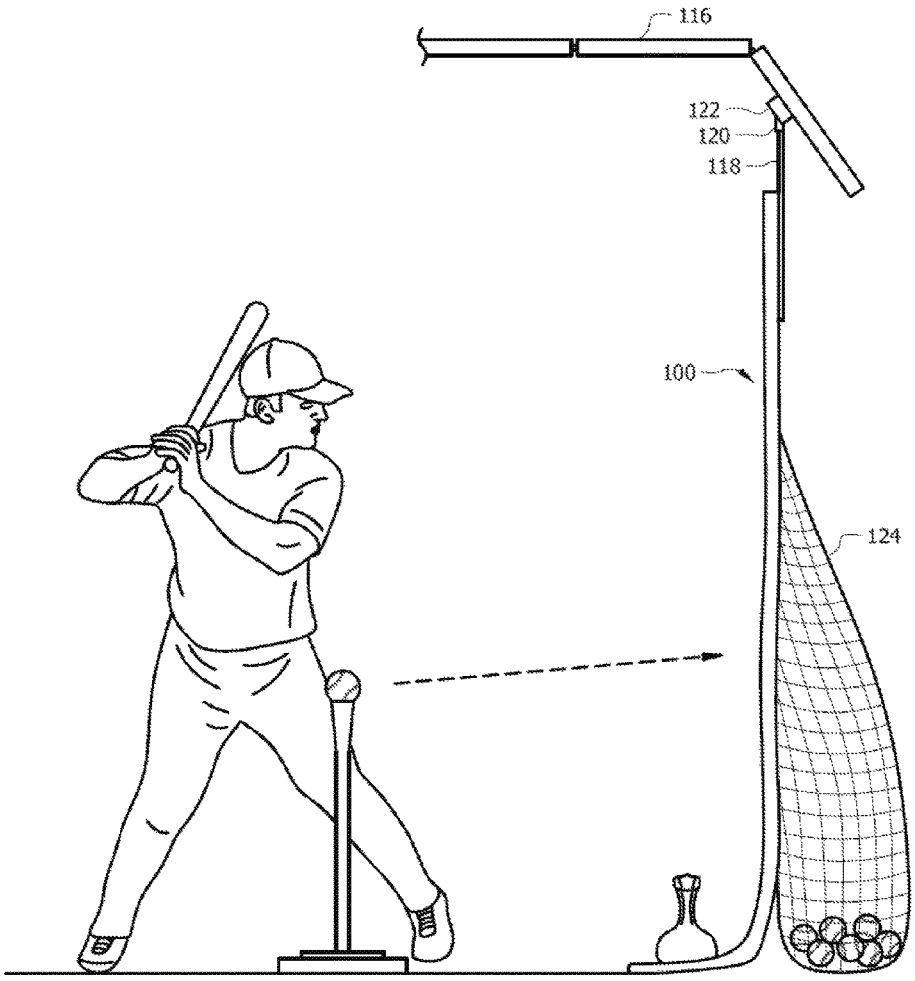
FIG. 3 is a side view of the invention as depicted in FIG. 1.
Figure 4:
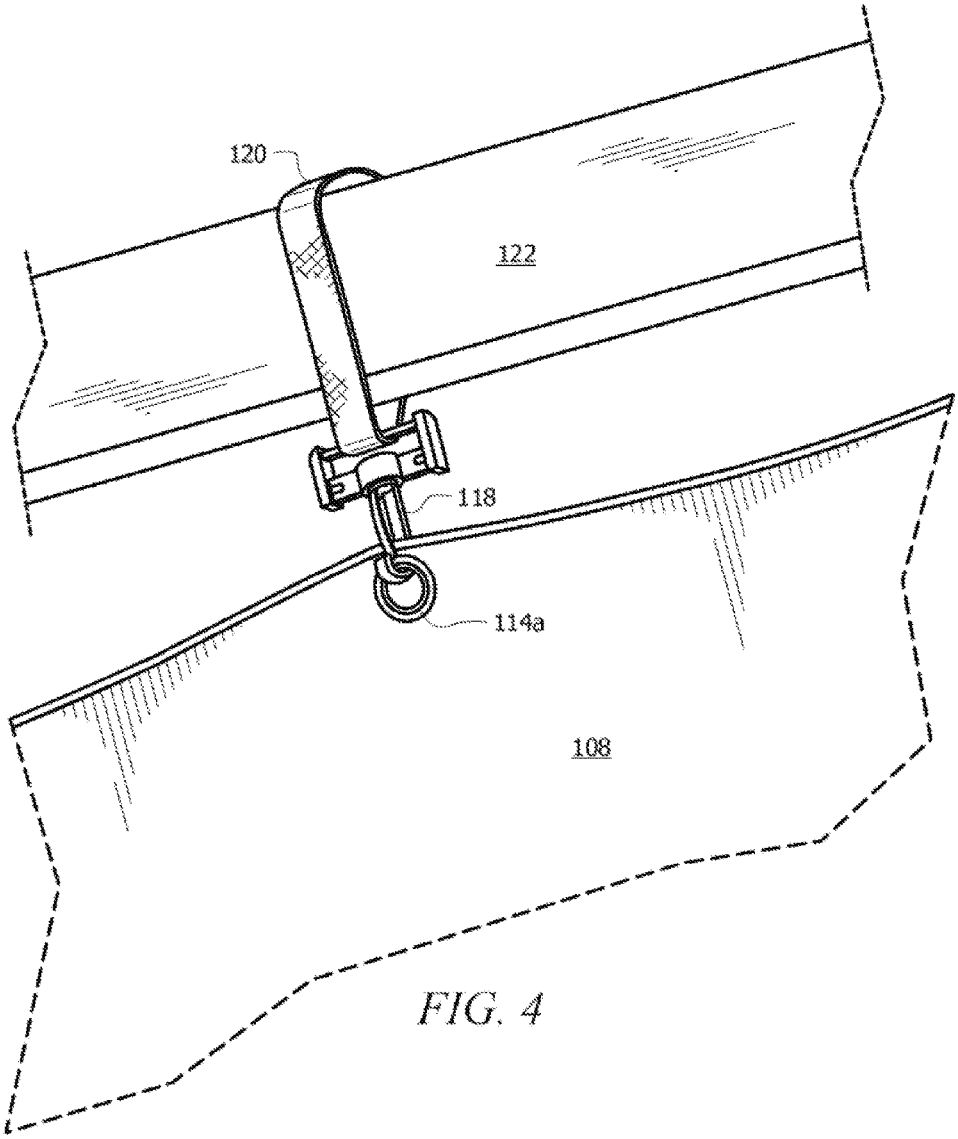
FIG. 4 is a close-up view of an embodiment of the storage sleeve secured to a horizontal support member on a garage door.

As shown most clearly in FIG. 3, an embodiment includes strap 120 secured to a horizontal structural member 122, such as a horizontal hurricane brace, on garage door 116. Strap 120, however, is versatile enough to be attached to any structural member of garage door 116. For example, the embodiment shown in FIG. 5 includes strap 120 secured to roller mechanism 130.

Strap 120 is preferably a hook and loop fastener so that a user can easily attach strap 120 to garage door 116 without having to permanently modify garage door 116. An embodiment may use other known attachment devices, but it is particularly advantageous to use an easily attachable fastener that does not require any permanent alterations to the existing garage structure.

In an embodiment, strap 120 may be secured to any structural member, however, it is desirable to secure strap 120 to a structural member that can be lowered to allow a user to more easily roll net 100 into sleeve 108.

Referring to FIGS. 1 and 3, net 100 further includes receiving pocket/sleeve 124. As most easily seen in FIG. 3, receiving pocket 124 extends out of the backside of net 100 and acts as a closed pouch for gathering baseballs or other similar projectiles that pass into pocket 124. Receiving pocket 124 includes opening 126 in net 100, which can be generally located in the center of the front side of net 100 as shown in FIG. 1. In an embodiment, opening 126 includes visible border 128 to easily distinguishing opening 126 from the rest of net 100. As a result, the athlete is provided with a visible target.

Figure 5A:
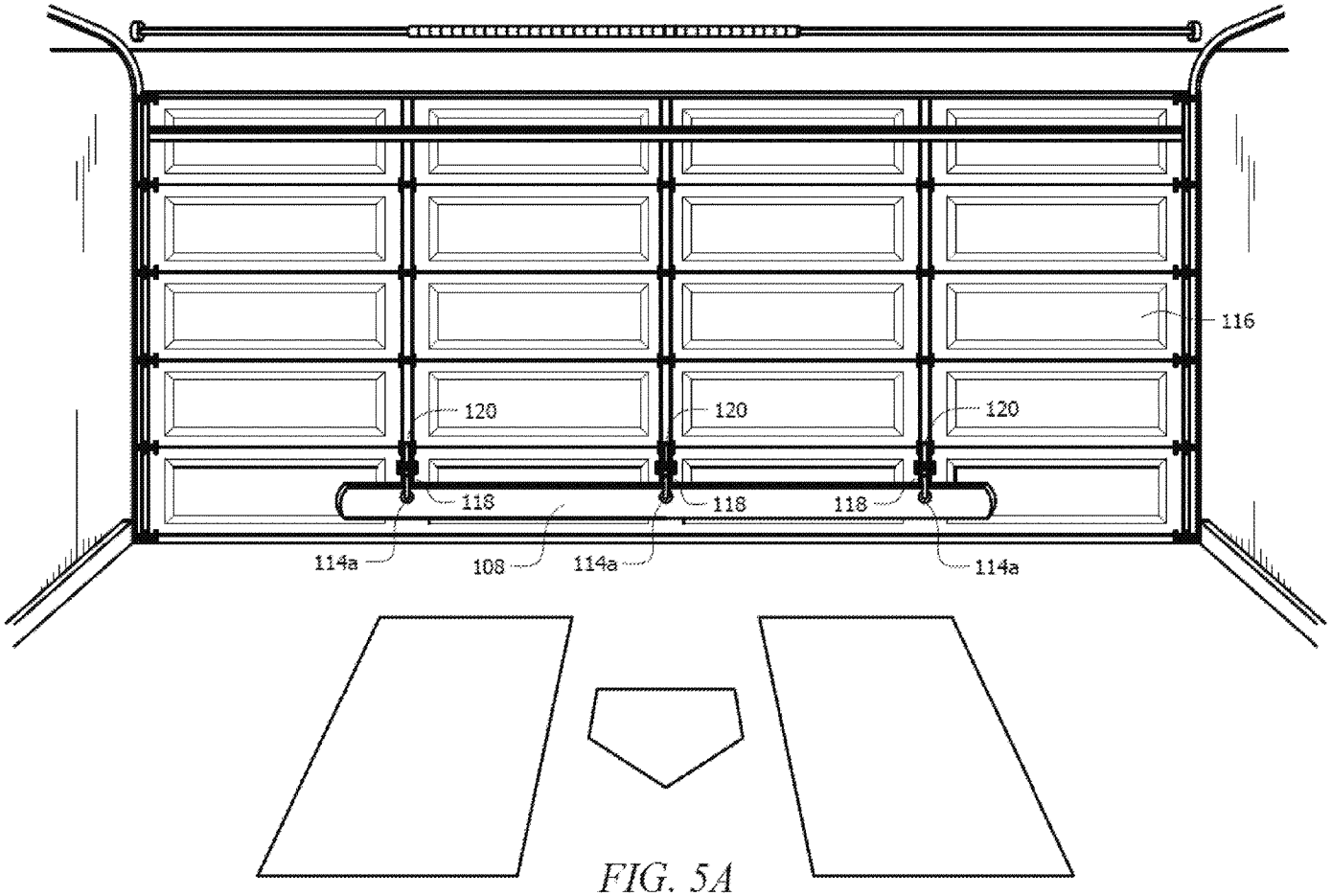
FIG. 5A depicts an embodiment of the present invention wherein the training net is secured within the storage sleeve.
Figure 5B:
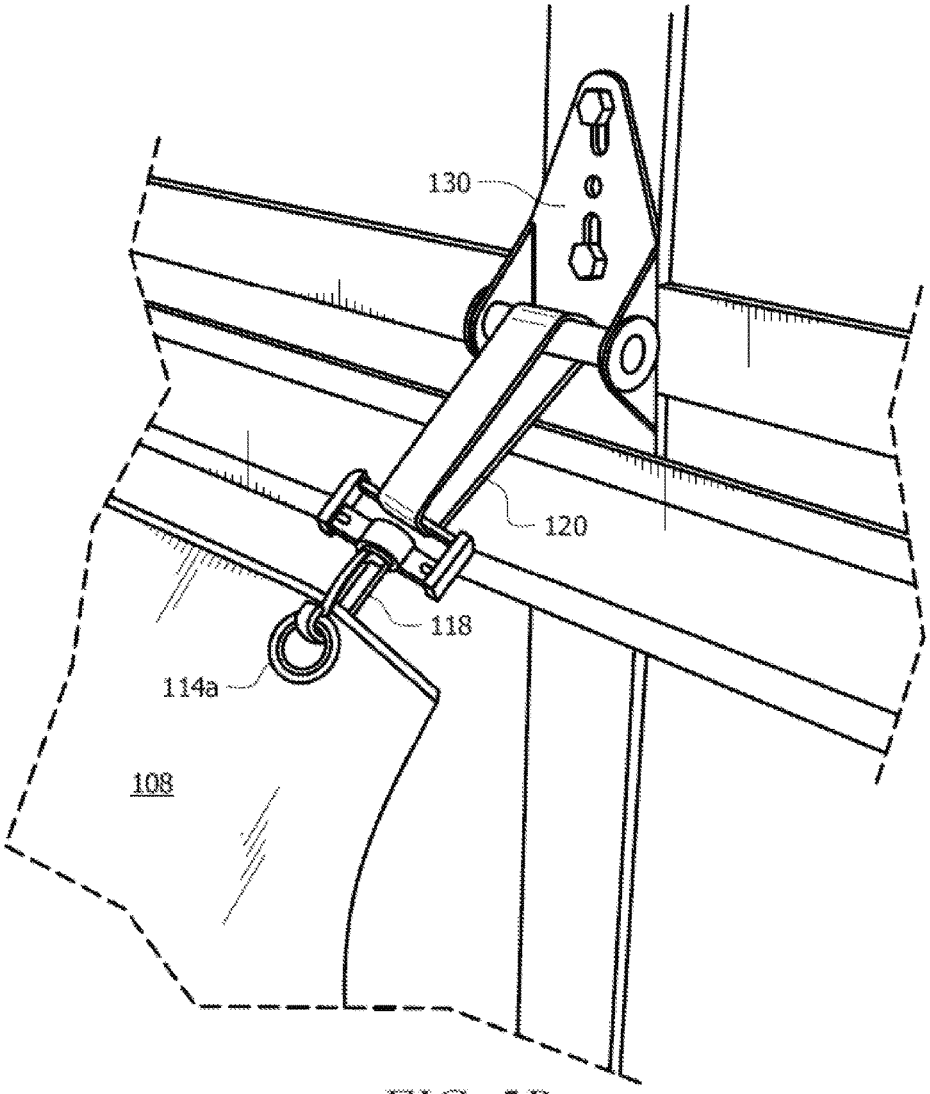
FIG. 5B is a close-up view of an embodiment of the storage sleeve secured to a roller mechanism on a garage door.

Referring now to FIGS. 5A-5B, an embodiment includes three upper grommets 114*a* and three lower grommets 114*b*. Each of upper grommets 114*a* are laterally spaced roughly forty-six inches with respect to each other, and each of lower grommets 114*b* are similarly spaced. This spacing ensures that grommets 114*a*, 114*b* are vertically aligned with roller mechanisms 130 found on a typical two-car garage door 116. Certain garage doors do not have horizontal hurricane braces, but a majority of new garage doors include roller mechanisms 130, which enable the garage door to separate and transition between an opened and closed position. This three-grommet design and spacing allows the storage sleeve to attach to either horizontal bracing 122 or roller mechanisms 130.

An embodiment may also include additional fasteners located on the upper and lower ends of the storage sleeve, such as hook and loop fasteners. The additional fasteners allow the storage sleeve to more fully enclose and secure the training net when in the storage configuration.

Figure 6:
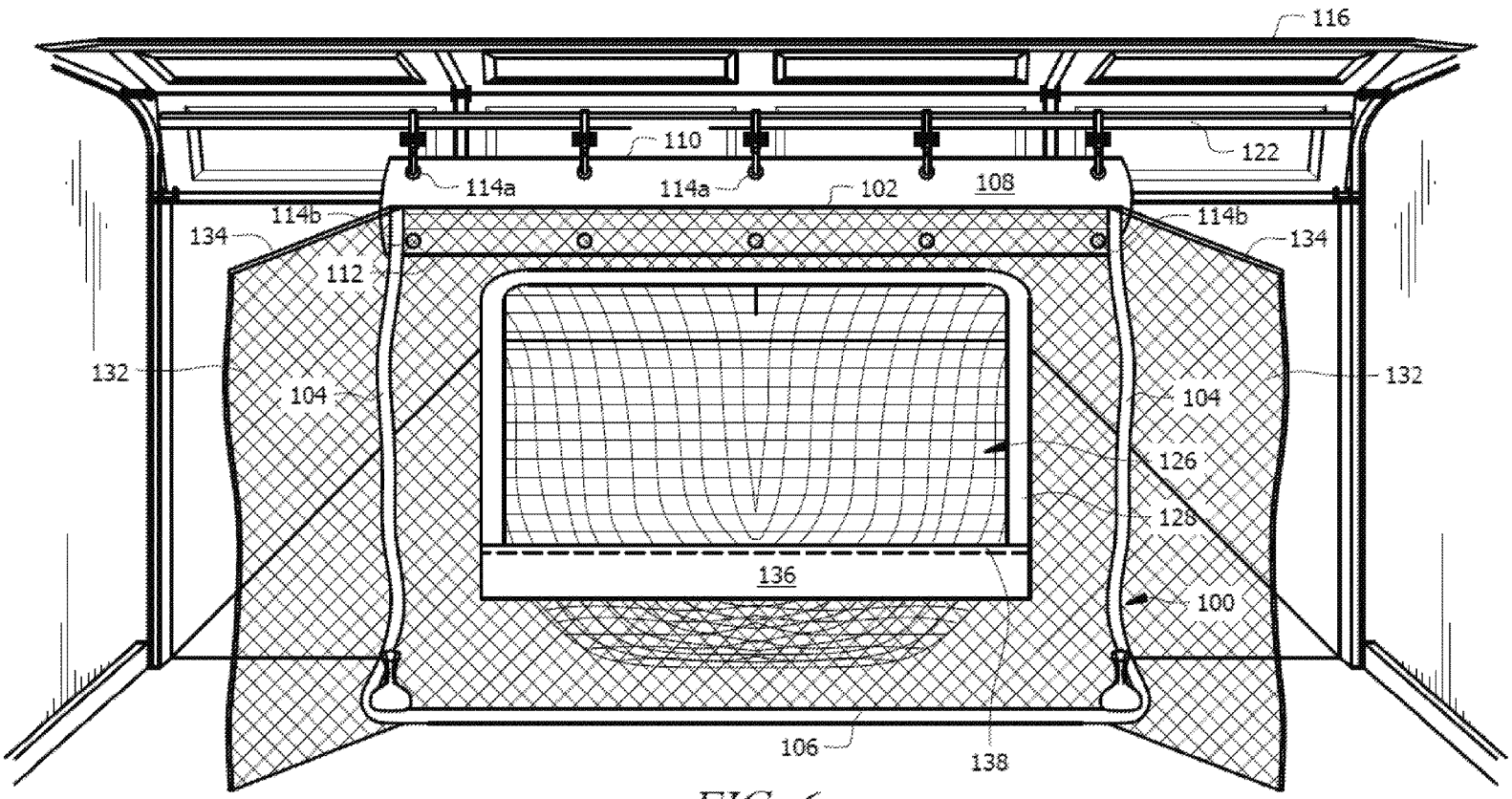
FIG. 6 is an elevation view of an embodiment of the present invention wherein the training net is suspended from the garage door when the garage door is in an open configuration.

Referring now to FIG. 6, an embodiment of the training net includes side sections of netting 132 suspended from support member 134. Support members 134, and in turn side sections of netting 132, are preferably angled towards the user of the net to create more of an enclosed receiving area. Ultimately, the side section of netting 132 are intended to prevent errant sporting projectiles from exiting the confines of the training net when mishit by a user.

Support members 134 are removably attached to a section of net 100 or sleeve 108 near upper end 102 of net 100. An embodiment may include an additional support member extending along the upper end 102 of net 100 to which support members 134 are removably secured. Alternatively, support members 134 may pivot at the connection point to net 100, sleeve 108, or the additional support member.

In an embodiment, support member 134 has an adjustable length through any mechanical properties known to a person of ordinary skill in the art, including but not limited to a telescoping design or through separable and foldable sections. The adjustable length allows the entire assembly to reduce in size to reduce the costs associating with shipping and packaging.

FIG. 6 also depicts projectile barrier 136 designed to keep sporting projectiles from bouncing out of receiving pocket 124. Barrier 136 is preferably planarly aligned with opening 126 with an upper end of barrier 136 at a distance of around twelve inches from the bottom of the net. Barrier 136 is preferably positioned a distance from the ground that is greater than the expected bounce height, after landing in pocket 124, of the projectile for which the net was intended to be used. Barrier 136 preferably includes a height of around eight inches and preferably extends the full width of opening 126.

Barrier 136 preferably includes support rod 138 from which barrier 136 hangs. Support rod 138 provides the rigidity necessary to keep barrier 136 in a generally horizontal and semi-rigid orientation. In addition, support rod 138 is preferably insertable and removable through an eye hole formed in the upper end of barrier 136. Similar to support member 134, support rod 138 may be collapsible in length to reduce the size of the assembly for shipping and packaging.

An embodiment includes an additional reinforcing net secured within the opening 126. The reinforcing net is removably attached using clips or other fastening devices known to a person of ordinary skill in the art. The reinforcing net acts as an intermediate dampener to prevent the sports object from striking receiving pocket 124 as full speed. Ultimately, the reinforcing net takes the brunt of the impact to increase the longevity of the receiving pocket.

Figure 7A:
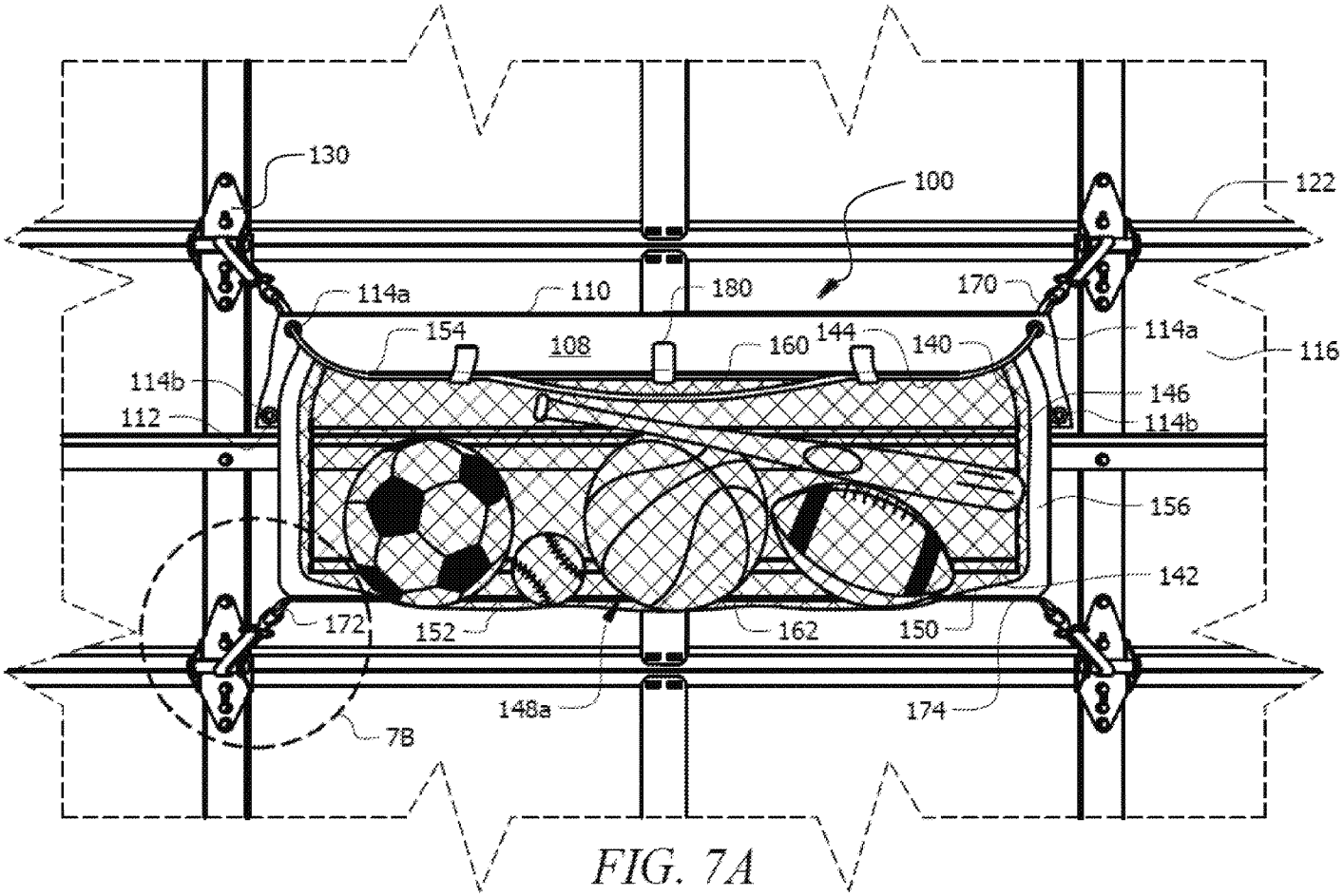
FIG. 7A is an elevation view of an embodiment of the present invention wherein the storage net is suspended from the garage door when the garage door is in a closed configuration.

Referring now to FIG. 7A, an alternative embodiment of net 100 is depicted. In the embodiment of FIG. 7A, net 100 is a storage net, which is generally rectangular in shape, similar to the net discussed above. Net 100 includes front barricade 150 adjacent to rear barricade 140, with rear barricade 140 serving as a backing for net 100. Front barricade 150 is translatable away from rear barricade 140, allowing a user to access the space disposed between the barricades. As shown in FIG. 7A, rear barricade 140 is comprised of mesh netting 148*a*, which is a flexible material having sufficient tensile strength to stretch without breaking, and which includes openings between the mesh, allowing a user to view the contents thereof. FIG. 7A shows that front barricade 150 is also comprised of a mesh netting material.

Each of rear barricade 140 and front barricade 150 is generally rectangular in shape. As such, rear barricade 140 includes upper end 144, lower end 142, and sides 146; similarly, front barricade 150 includes upper end 154, lower end 152, and sides 156. Since the barricades are generally rectangular in shape, the upper ends and lower ends have a height extending therebetween, and the sides have a width extending therebetween.

Rear and front barricades 140, 150 are joined at respective lower ends. In an embodiment, the barricades are part of a continuous net, in which one end is folded toward another end, forming the rear and front barricades. In an alternative embodiment, the barricades are separate components that are joined together through stitching, adhesives, a common fabric border, hook-and-loops fasteners, one or more elastic cords, or other similar fastening mechanisms. As shown in FIG. 7A, receiving pocket 160 is disposed between rear and front barricades 140, 150, with the respective lower ends of the barricades forming a base for pocket 160. Pocket 160 is adapted to receive items 162 to be stored and retained within net 100.

Upper end 144 of rear barricade 140 is secured to storage sleeve 108, which is discussed in greater detail above. Net 100 is designed to hang from storage sleeve 108 in a first storage configuration, in which items 162 may be stored within net 100, as shown in FIG. 7A. In addition, upper end 154 of front barricade 150 is removably secured to storage sleeve 108, such as via clips 180, thereby allowing items 162 to be stored in pocket 160, as described above. Clips 180 may be a part of a hook and loop fastener, an adhesive-based fastener, a slot and groove fastener, or other fasteners known within the art, the purpose of which is to secure front barricade 150 to storage sleeve 108.

Still referring to FIG. 7A, net 100 includes elastic cord 170 at upper end 154 of front barricade 150. Elastic cord 170 is inserted through at least one of upper grommets 114*a* to secure net 100, and consequently storage sleeve 108, to garage door 116. As discussed above, net 100 secures to roller mechanism 130 disposed on structural member 122 of garage door 116. In addition, as shown in FIG. 7A, garage door 116 includes a plurality of panels, which include spaced-apart roller mechanisms 130 and structural members 122. In an embodiment, elastic cord 170 spans between subsequent horizontally-aligned roller mechanisms 130, such that elastic cord 170 has a length less than or equal to the distance between the subsequent roller mechanisms 130—on a standard double-garage door, the distance between subsequent roller mechanisms is approximately 40-50 inches.

When the portion of elastic cord 170 at upper end 154 of front barricade 150 is mechanically connected to the subsequent roller mechanisms 130, elastic cord 170 is under a tension force due to it being stretched between roller mechanisms 130. While elastic cord 170 is under a tension force, elastic cord 170 is in a resting configuration absent a manual external force, such as a pulling force applied by a user. In the resting configuration, elastic cord 170 is designed to be disposed proximate to storage sleeve 108. However, elastic cord 170 is also designed to receive a pulling force from a user, such that the user can gain access to receiving pocket 160. To interact with receiving pocket 160, a user manipulates elastic cord 170 to pull elastic cord 170 away from storage sleeve 108, thereby further stretching and deforming elastic cord 170. Elastic cord 170 rebounds back to the resting configuration when it is no longer subject to an external force, such as the pulling force applied by the user to gain access to pocket 160. In an alternative embodiment, two separate elastic cords are disposed at opposing sides of one of rear and front barricades 140, 150, with the two elastic cords adapted to extend from the corners of net 100 to mechanically connect net 100 to roller mechanisms 130.

It is appreciated that upper end 154 of front barricade 150 need not include elastic cord 170 to allow access to receiving pocket 160. Instead, in alternative embodiments, different materials may be disposed at upper end 154 of front barricade 150 to secure items 162 within pocket 160 and provide an access mechanism to pocket 160. Such materials may be made of rope, vinyl, textile, or another flexible material that is capable of receiving a pulling force from a user without breaking. The materials may be secured against rear barricade 140, or storage sleeve 108, via a hook and loop fastener, temporary adhesives, a slot-and-groove fastener, complementary magnets, a button-and-hole fastener, or other similar detachable fasteners known in the art. In addition, upper end 154 may include an aperture allowing for a telescoping mechanism, such that a material can be inserted into the aperture to secure upper end 154 against rear barricade 140, and temporarily removed from the aperture to allow a user to pull front barricade 150 away from rear barricade 140, allowing access to pocket 160.

Elastic cord 170 may form a continuous border of net 100 by intertwining with respective sides 146, 156, as well as respective lower ends 142, 152, of rear and front barricades 140, 150. For example, lower elastic cord 174 is shown in FIG. 7A, with lower elastic cord 174 connecting net 100 to garage door 116 at a lower end of net 100. Similar to elastic cord 170, lower elastic cord 174 spans between subsequent horizontally-aligned roller mechanisms 130, such that elastic cord 170 has a length less than or equal to the distance between the subsequent roller mechanisms 130, thereby allowing lower elastic cord 174 to be stretched and deformed to couple with the subsequent roller mechanisms 130.

Figure 7B:
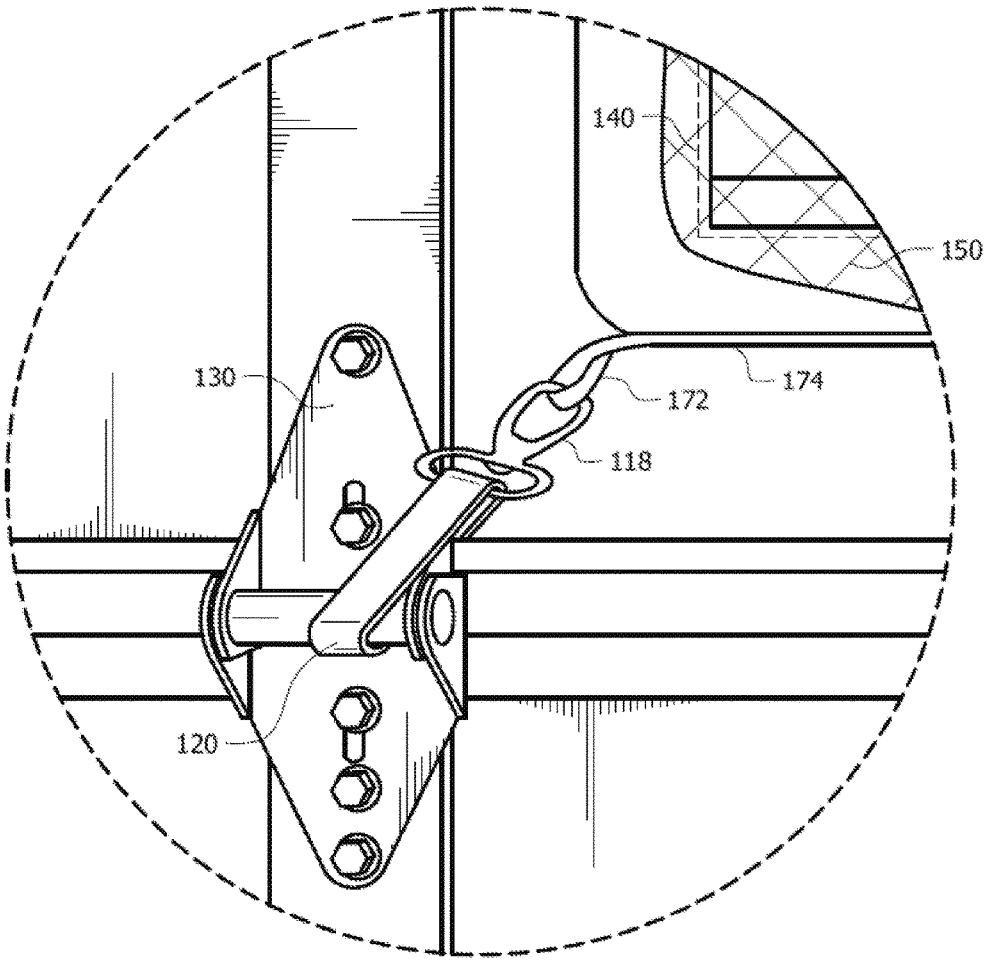
FIG. 7B is a close-up view of an embodiment of the storage net secured to a roller mechanism on a garage door via an elastic cord.

FIG. 7B shows the attachment of lower elastic cord 174 for one of the roller mechanisms 130. Lower elastic cord 174 forms loop 172, which provides an attachment point for hook 118, as described above. Hook 118 and strap 120 thereby secure net 100 to roller mechanism 130 in the manner described above. The same mechanism is used to secure elastic cord 170 disposed at upper end 154 of front barricade 150 to different roller mechanisms 130.

Figure 8:
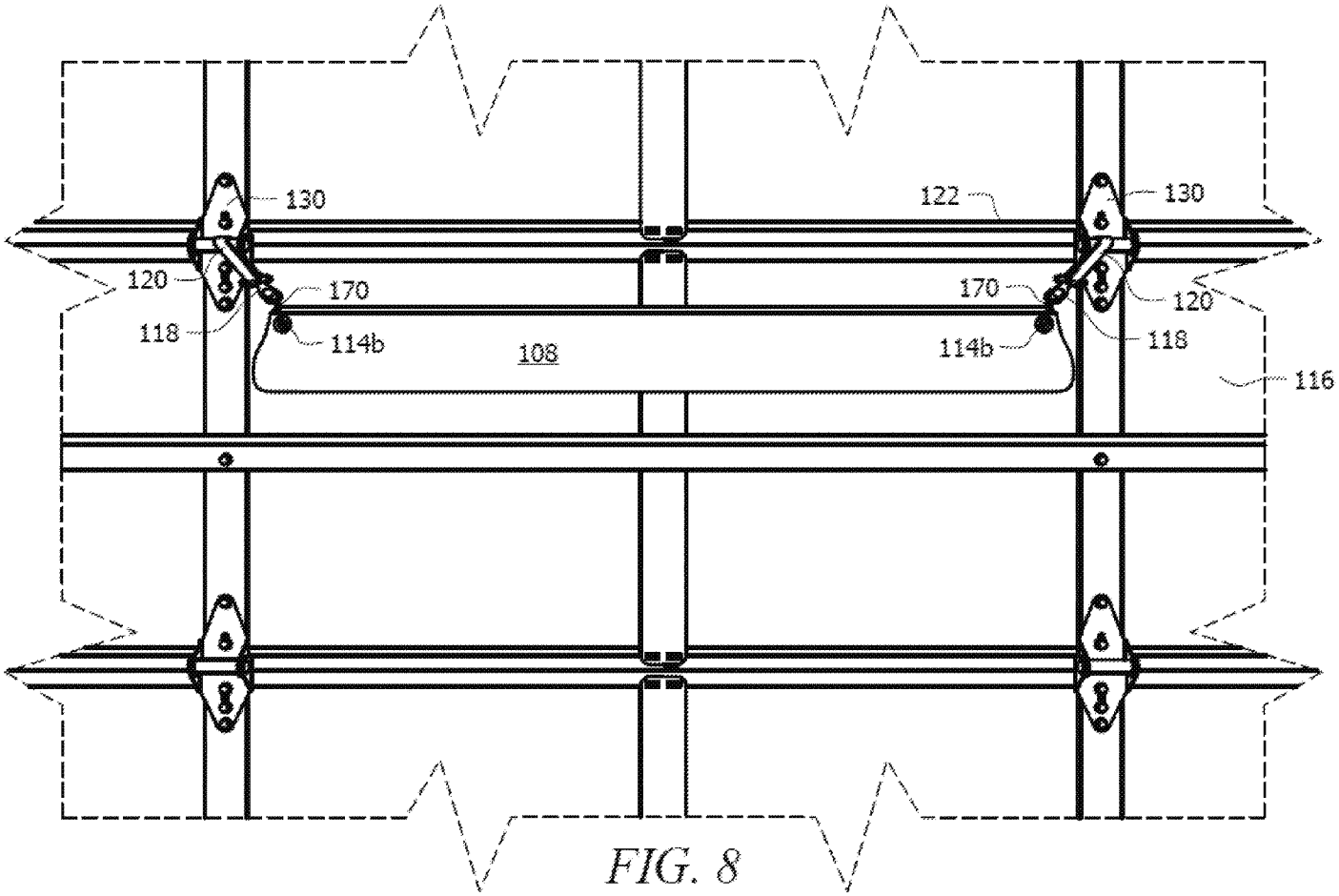
FIG. 8 depicts an embodiment of the present invention wherein the storage net is secured within the storage sleeve.

As shown in FIG. 8, storage sleeve 108 is disposed to receive and retain net 100 in a second storage configuration. Net 100 can be rolled into a middle portion of storage sleeve 108, between upper end 110 and lower end 112. To facilitate the storage process, rear barricade 140 is secured to storage sleeve 108 between upper grommets 114*a* and lower grommets 114*b*, such that when lower grommets 114*b* are translated toward upper grommets 114*a*, net 100 is secured within storage sleeve 108. The securing of rear barricade 140 to storage sleeve 108 may be permanent, such as via an adhesive or stitching, or may be temporary, such as via a hook-and-loop fastener, allowing rear barricade 140 to be removable from storage sleeve 108.

Figure 9:
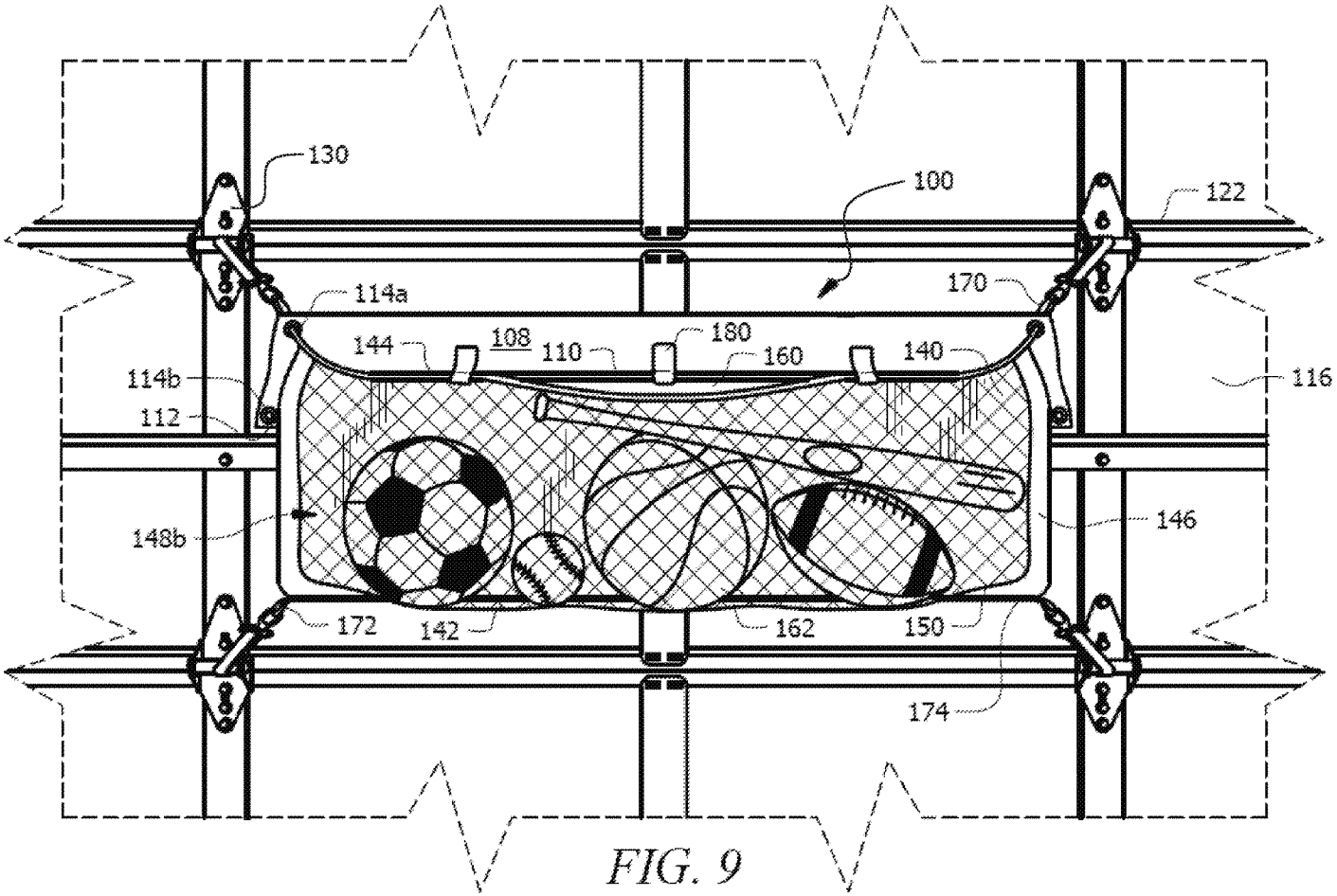
FIG. 9 depicts an embodiment of the present invention wherein the storage net includes a solid backing and is suspended from the garage door when the garage door is in a closed configuration.

FIG. 9 shows an alternative embodiment of net 100, in which rear barricade 140 of net 100 includes solid backing 148*b*. Solid backing 148*b* may be made from a material similar to that of storage sleeve 108, with the material being smooth and preferably impermeable, such as a two-ply vinyl fabric. The two-ply fabric provides additional durability while still remaining pliable for attaching to the net. The vinyl fabric includes the added benefits of being durable, inexpensive to manufacture, easy to clean, and odor resistant. In addition, solid backing 148*b* prevents external substances, such as liquid, dust, and dirt, from entering net 100 from garage door 116, particularly when garage door 116 is raised and lowered. In the embodiment of FIG. 9, front barricade 150 of net 100 includes a mesh netting, allowing a user to view items 162 stored within net 100. In an embodiment, the entirety of rear barricade 140 is made from a material that is solid and impermeable to liquid.

Glossary of Claim Terms

Barricade: is a material barrier that partially encloses a space.

Elastic: capable of rebounding to a position of repose or recovering size and shape after being stretched or deformed.

Grommet: is a ring made of a stronger material than a surrounding fabric, such as metal or plastic, that is used to strengthen a small hole in the fabric. While grommets are typically ring shaped, it is considered that the grommets may have other shapes so long as the hole in the fabric is reinforced.

Hook: is a structural member that is curved or bent back at an angle for catching hold of or hanging things thereon.

Net: is a fabric barricade.

Strap: is a strip of material used to fasten, secure, or hold onto something.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A storage net, comprising:

a rear barricade including a lower end and an upper end with a height extending therebetween, and a pair of sides with a width extending therebetween;

a front barricade including a lower end and an upper end with a height extending therebetween, and a pair of sides with a width extending therebetween, the rear and front barricades joined at respective lower ends;

a receiving pocket disposed between the rear and front barricades and adapted to receive and retain items for storage within the net; and a storage sleeve affixed to the upper end of the rear barricade, wherein the storage sleeve further includes:

an upper end having a plurality of upper grommets;

a lower end having a plurality of lower grommets;

at least two of the upper grommets each vertically aligned with one of the lower grommets.

2. The storage net of claim 1, wherein the storage sleeve has a width greater than or equal to the width of the rear barricade.

3. The storage net of claim 1, wherein the storage sleeve is comprised of a smooth outer surface.

4. The storage net of claim 1, further including a plurality of hook and strap fasteners, wherein each of the plurality of straps is secured around a structural member of a garage door and each of the plurality of hooks is received by one of the plurality of upper grommets.

5. The storage net of claim 1, further including an elastic cord disposed at the upper end of the front barricade, the elastic cord coupling the front barricade with the storage sleeve though at least one of the plurality of upper grommets.

6. The storage net of claim 5, further including a plurality of hook and strap fasteners, wherein each of the plurality of straps is secured around a roller mechanism of a garage door and each of the plurality of hooks is received by a loop formed by the elastic cord.

7. The storage net of claim 6, further including a first storage configuration wherein the rear and front barricades are enfolded in the storage sleeve by securing both the plurality of upper grommets and the plurality of lower grommets with the plurality of hooks.

8. The storage net of claim 6, further including a second storage configuration wherein the plurality of upper grommets remains secured by the plurality of hooks while the plurality of lower grommets is unengaged from the plurality of hooks, thereby allowing the storage net to suspend vertically from the garage door.

9. The storage net of claim 6, further including a lower elastic cord disposed at the lower ends of the rear and front barricades, the lower elastic cord having a length that is less than or equal to a distance between subsequent horizontally-aligned roller mechanisms, such that the elastic cord is under tension when attached to the garage door.

10. The storage net of claim 1, wherein the front barricade is removably affixed to the storage sleeve between the upper grommets and the lower grommets via at least one clip.

11. A storage net, comprising:

a rear barricade including a lower end and an upper end with a height extending therebetween, and a pair of sides with a width extending therebetween;

a front barricade including a lower end and an upper end with a height extending therebetween, and a pair of sides with a width extending therebetween, the rear and front barricades joined at respective lower ends;

a receiving pocket disposed between the rear and front barricades and adapted to receive and retain items for storage within the net;

an elastic cord in mechanical communication with at least one of the front barricade and the rear barricade, the elastic cord adapted to mechanically connect to at least one of a plurality of roller mechanisms disposed on a garage door, and having an unstretched length less than or equal to a distance between subsequent horizontally-aligned roller mechanisms, such that the elastic cord is under tension when attached to the garage door; and a storage sleeve affixed to the upper end of the rear barricade, the storage sleeve including an upper end having an upper grommet and a lower end having a lower grommet, wherein the storage sleeve is disposed to receive the rear and front barricade therein, such that the rear and front barricades may be enfolded in the storage sleeve.

12. The storage net of claim 11, wherein the storage sleeve further includes:

a plurality of upper grommets disposed at the upper end;

a plurality of lower grommets disposed at the lower end; and at least two of the plurality of upper grommets each vertically aligned with one of the plurality of lower grommets.

13. The storage net of claim 12, wherein the storage sleeve has a width greater than or equal to a width of the rear barricade.

14. The storage net of claim 12, wherein the front barricade is removably affixed to the storage sleeve between the plurality of upper grommets and the plurality of lower grommets via at least one clip.

15. The storage net of claim 12, further including a first storage configuration wherein the rear and front barricades are enfolded in the storage sleeve by securing both the plurality of upper grommets and the plurality of lower grommets with a plurality of hooks that are in mechanical communication with the elastic cord and at least two of the plurality of roller mechanisms.

16. The storage net of claim 11, further including a plurality of hook and strap fasteners, wherein each of the plurality of straps is secured around one of the plurality of roller mechanisms disposed on the garage door and each of the plurality of hooks is received by a loop formed by the elastic cord.

17. A storage net, comprising:

a liquid impermeable rear barricade including a lower end and an upper end with a height extending therebetween, and a pair of sides with a width extending therebetween;

a front barricade including a lower end and an upper end with a height extending therebetween, and a pair of sides with a width extending therebetween, the lower end of the front barricade affixed proximate to the lower end of the liquid impermeable rear barricade, a receiving pocket disposed between the liquid impermeable rear barricade and the front barricade, the receiving pocket being adapted to receive and retain items for storage within the net;

whereby the liquid impermeable rear barricade is adapted to prevent exterior substances from contacting the front barricade;

a first fastener on one side of the storage net, a second fastener on an opposite side of the storage net, wherein the first fastener mechanically connects to a first roller mechanism of a garage door and the second fastener mechanically connects to a second roller mechanism that is laterally spaced from the first roller mechanism when the storage net is secured to a garage door;

the widths of the front and liquid impermeable rear barricades each being less than or equal to the distance between first and second laterally spaced roller mechanisms on the garage door on which the storage net is secured; and a storage sleeve affixed to the upper end of the liquid impermeable rear barricade, the storage sleeve including an upper end having an upper grommet and a lower end having a lower grommet, wherein the storage sleeve is disposed to receive the liquid impermeable rear barricade and the front barricade therein, such that liquid impermeable rear barricade and the front barricades may be enfolded in the storage sleeve.

18. The storage net of claim 17, wherein the storage sleeve further includes:

a plurality of upper grommets disposed at the upper end;

a plurality of lower grommets disposed at the lower end; and at least two of the plurality of upper grommets each vertically aligned with one of the plurality of lower grommets.

19. The storage net of claim 18, further including a first storage configuration wherein the liquid impermeable rear barricade and the front barricade are enfolded in the storage sleeve by securing both the plurality of upper grommets and the plurality of lower grommets with at least one of the first and second fasteners that are in mechanical communication with at least two horizontally-aligned roller mechanisms.

20. The storage net of claim 17, further including an elastic cord in mechanical communication with at least one of the front barricade and the liquid impermeable rear barricade, the elastic cord adapted to couple with subsequent horizontally-aligned roller mechanisms via the first and second fasteners, the elastic cord having a length less than or equal to a distance between the subsequent horizontally-aligned roller mechanisms, such that the elastic cord is under tension when attached to the garage door.

* * * * *